US008682492B2

(12) United States Patent
Koyanagi et al.

(10) Patent No.: US 8,682,492 B2
(45) Date of Patent: Mar. 25, 2014

(54) SETTING VALUE CONTROLLING METHOD AND DEVICE

(75) Inventors: Takashi Koyanagi, Tokyo (JP); Naofumi Ushioda, Tokyo (JP); Masato Tanaka, Tokyo (JP)

(73) Assignee: Azbil Corporation, Tokyo (JP)

( * ) Notice: Subject to any disclaimer, the term of this patent is extended or adjusted under 35 U.S.C. 154(b) by 155 days.

(21) Appl. No.: 13/112,460

(22) Filed: May 20, 2011

(65) Prior Publication Data

US 2011/0288687 A1 Nov. 24, 2011

(30) Foreign Application Priority Data

May 21, 2010 (JP) ..... 2010-117136

(51) Int. Cl.

| | |
|---|---|
| ***G05B 13/00*** | (2006.01) |
| ***G05B 15/00*** | (2006.01) |
| ***G05D 23/00*** | (2006.01) |
| ***G01K 15/00*** | (2006.01) |
| ***G01K 19/00*** | (2006.01) |
| ***G06F 11/30*** | (2006.01) |
| ***G21C 17/00*** | (2006.01) |
| ***F24F 11/053*** | (2006.01) |

(52) U.S. Cl.
USPC ..... 700/278; 700/291; 702/99; 702/182; 236/1 C; 236/91 D

(58) Field of Classification Search
USPC ..... 700/275, 276, 278, 291; 702/99, 130, 702/182; 236/1 C, 94, 91 D
See application file for complete search history.

(56) References Cited

U.S. PATENT DOCUMENTS

| | | | | | |
|---|---|---|---|---|---|
| 4,215,408 | A | * | 7/1980 | Games et al. | 700/278 |
| 4,460,125 | A | * | 7/1984 | Barker et al. | 236/94 |
| 4,487,028 | A | * | 12/1984 | Foye | 62/115 |
| 4,926,839 | A | * | 5/1990 | Sugawara et al. | 126/96 |
| 5,224,353 | A | | 7/1993 | Nagasawa | |

(Continued)

FOREIGN PATENT DOCUMENTS

| | | | |
|---|---|---|---|
| CN | 1959240 | A | 5/2007 |
| CN | 101201202 | A | 6/2008 |

(Continued)

OTHER PUBLICATIONS

Korean office action dated Oct. 11, 2012 issued in the Korean counterpart (KR 10-2011-0031246) to the instant U.S. Appl. No. 13/112,460.

(Continued)

*Primary Examiner* — Crystal J Barnes-Bullock
(74) *Attorney, Agent, or Firm* — Troutman Sanders LLP

(57) ABSTRACT

A setting value controlling device comprises: a setting value information collecting and storing portion for collecting and storing temperature setting values from an air-conditioner controlling device; a setting value reset evaluating portion for resetting the temperature setting value to a reference setting value if the temperature setting value is not a more energy-conserving setting than the reference setting value when a specific reset time has been reached; and a reference setting value updating portion for updating the reference setting value to the updated temperature setting value if, when the temperature setting value has been updated by a user, the updated temperature setting value is a more energy-conserving setting than the reference setting value and a specific time interval has elapsed since updating of the temperature setting value.

10 Claims, 7 Drawing Sheets

(56) References Cited

U.S. PATENT DOCUMENTS

| | | | | |
|---|---|---|---|---|
| 5,947,371 | A * | 9/1999 | Lee | 236/49.3 |
| 7,055,760 | B2 * | 6/2006 | Paul et al. | 237/12.3 C |
| 7,243,503 | B2 * | 7/2007 | Lee | 62/228.5 |
| 8,020,778 | B2 * | 9/2011 | Murakami et al. | 236/1 C |
| 8,074,636 | B2 * | 12/2011 | Nishio et al. | 126/116 A |
| 8,219,252 | B2 * | 7/2012 | Nanami | 700/278 |
| 8,306,669 | B1 * | 11/2012 | Smith et al. | 700/286 |

FOREIGN PATENT DOCUMENTS

| | | | |
|---|---|---|---|
| CN | 101307944 | A | 11/2008 |
| JP | 05-087372 | A | 4/1993 |
| JP | 8-121849 | A | 5/1996 |
| JP | 2000-018670 | A | 1/2000 |
| JP | 2005-016915 | A | 1/2005 |
| JP | 2008045810 | A | 2/2008 |
| JP | 2008-241156 | A | 10/2008 |
| JP | 2008-286445 | A | 11/2008 |
| KR | 1995-0003790 | B1 | 4/1995 |
| KR | 2002-0031368 | A | 5/2002 |

OTHER PUBLICATIONS

Chinese Search Report, dated May 9, 2013, which issued during the prosecution of Chinese Patent Application No. 201110139396.4.

Chinese Office Action, dated Dec. 18, 2013, which issued during the prosecution of Chinese Patent Application No. 201110139396.4, which corresponds to the present application.

* cited by examiner

FIG. 7

| Total | Air-conditioner Operating Time | 25°C | 25.5°C | 26°C | 26.5°C | 27°C | 27.5°C | 20°C |
|---|---|---|---|---|---|---|---|---|
| 336h | 120 h | 0 h | 0 h | 30 h | 45 h | 0 h | 45 h | 0 h |

SETTING VALUE CONTROLLING METHOD AND DEVICE

CROSS REFERENCE TO RELATED APPLICATIONS

The present application claims priority under 35 U.S.C. §119 to Japanese Patent Application No. 2010-117136, filed May 21, 2010, which is incorporated herein by reference.

FIELD OF TECHNOLOGY

The present invention relates to a setting value controlling method and device for controlling a temperature setting value that is set for an air-conditioned space wherein an air-conditioned device controls a room temperature.

BACKGROUND OF THE INVENTION

Conventionally, in air-conditioning control systems for, for example, office buildings, a temperature setting value is resetted to a reference setting value, which has been set in advance, when a specific time is reached (for example, 8 AM the following morning). The reference setting value is set so as to minimize energy consumption while maintaining a comfortable temperature within the space that is being controlled, and so is set to, for example, 26° C. for cooling or 22° C. for heating.

In this way, in the setting value controlling method disclosed in Japanese Unexamined Patent Application Publication 2008-286445 ("JP '445"), the setting value is updated to the reference setting value at a specified time, in consideration of the balance between the amount of energy used and the comfort within the room. However, when the current controlling mode is the cooling mode and the temperature setting value is set higher than the reference setting value, or when the current controlling mode is the heating mode and the temperature setting value is set lower than the reference setting value, then the amount of energy consumption would be reduced as much as possible by not updating the temperature setting value in the direction that would increase the energy consumption, by not resetting the reference setting value even when the specified time is reached.

In the setting value controlling method disclosed in JP '445, there is a problem in that the resetting to the reference setting value is not necessarily to the optimal setting for energy conservation. For example, when there are unexpectedly few heat-producing objects within the room when in the cooling mode, then even resetting to the reference setting value for energy conservation would result in excessive cooling. On the other hand, when there are unexpectedly many heat-producing objects within the room when in the heating mode, then even resetting to the reference setting would result in excessive heating.

The present invention was created in order to solve the problem areas set forth above, and the object thereof is to achieve further energy conservation in a setting value controlling method and device for resetting a temperature setting value to a reference setting value.

SUMMARY OF THE INVENTION

The present invention is a setting value controlling method for controlling a temperature setting value that is set for an air-conditioned space wherein an air-conditioned device controls a room temperature, having a first evaluating step for evaluating whether or not the current temperature setting value is a more energy-conserving setting than the reference setting value when a specific resetting time has been reached; a setting value resetting step for resetting the current temperature setting value to the reference setting value when it is evaluated, in the first evaluating step, that the current temperature setting value is not a more energy-conserving setting than the reference setting value; a second evaluating step for evaluating whether or the updated temperature setting value is a more energy-conserving setting than the reference setting value when a user has updated the temperature setting value; a third evaluating step for evaluating whether or not a specific time interval has elapsed since the time of updating of the temperature setting when it is evaluated, in the second evaluating step, that the updated temperature setting value is a more energy-conserving setting than the reference setting value; and a reference setting value updating step for updating the reference setting value to the updated temperature setting value when it is evaluated, in the third evaluating step, that the specific time interval has elapsed.

Additionally, the setting value controlling method according to the present invention has a first evaluating step for evaluating whether or not the current temperature setting value is a more energy-conserving setting than the reference setting value when a specific resetting time has been reached; a setting value resetting step for resetting the current temperature setting value to the reference setting value when it is evaluated, in the first evaluating step, that the current temperature setting value is not a more energy-conserving setting than the reference setting value; a second evaluating step for evaluating whether or not a specific time interval has elapsed since the time of setting or updating of the reference setting value; a third evaluating step for evaluating whether or not the temperature setting value is a more energy-conserving setting than the reference setting value for time that is no less than a specific proportion of the air-conditioner operating time over the specific time interval when it has been evaluated, in the second evaluating step, that the specific time interval has elapsed; a representative value calculating step for calculating a representative value for the temperature setting value over the specific time interval when it has been evaluated, in the third evaluating step, that the temperature setting value is a more energy-conserving setting than the reference setting value; and a reference setting value updating step for updating the reference setting value to the representative value when it has been evaluated, in the third evaluating step, that the temperature setting value is a more energy-conserving setting than the reference setting value.

Additionally, one composition example of a setting value controlling method according to the present invention further includes a fourth evaluating step for evaluating whether or not an outside temperature on a day on which the user has updated the temperature setting value is within a normal range; wherein: the reference setting value updating step is performed only if the outside temperature on the day on which the user has updated the temperature setting value is within the normal range. Additionally, in one composition example of a setting controlling method according to the present invention: the reference setting value updating step, when the user has updated the temperature setting value in the direction of an energy-conserving setting and then has updated the temperature setting value again in the direction of an energy-conserving setting prior to the elapsing of the interval, updates the reference setting value to the first updated temperature setting value when the specific interval has elapsed since the first updating of the temperature setting value, and updates the reference setting value to the second updated temperature setting value when the specific interval has elapsed since the second updating of the temperature setting value.

Additionally, the present invention is a setting value controlling device for controlling a temperature setting value that is set for an air-conditioned space wherein an air-conditioned device controls a room temperature, having setting value information collecting means for collecting temperature setting values from an air-conditioned device; first evaluating means for evaluating whether or not the current temperature setting value is a more energy-conserving setting than the reference setting value when a specific resetting time has been reached; setting value resetting means for resetting the current temperature setting value to the reference setting value when it is evaluated, by the first evaluating means, that the current temperature setting value is not a more energy-conserving setting than the reference setting value; second evaluating means for evaluating whether or the updated temperature setting value is a more energy-conserving setting than the reference setting value when a user has updated the temperature setting value; third evaluating means for evaluating whether or not a specific time interval has elapsed since the time of updating of the temperature setting when it is evaluated, by the second evaluating means, that the updated temperature setting value is a more energy-conserving setting than the reference setting value; and reference setting value updating means for updating the reference setting value to the updated temperature setting value when it is evaluated, by the third evaluating means, that the specific time interval has elapsed.

Additionally, the setting value controlling device according to the present invention has setting value information collecting means for collecting temperature setting values from an air-conditioned device; first evaluating means for evaluating whether or not the current temperature setting value is a more energy-conserving setting than the reference setting value when a specific resetting time has been reached; setting value resetting means for resetting the current temperature setting value to the reference setting value when it is evaluated, by the first evaluating means, that the current temperature setting value is not a more energy-conserving setting than the reference setting value; second evaluating means for evaluating whether or not a specific time interval has elapsed since the time of setting or updating of the reference setting value; third evaluating means for evaluating whether or not the temperature setting value is a more energy-conserving setting than the reference setting value for time that is no less than a specific proportion of the air-conditioner operating time over the specific time interval when it has been evaluated, by the second evaluating means, that the specific time interval has elapsed; representative value calculating means for calculating a representative value for the temperature setting value over the specific time interval when it has been evaluated, by the third evaluating means, that the temperature setting value is a more energy-conserving setting than the reference setting value; and reference setting value updating means for updating the reference setting value to the representative value when it has been evaluated, by the third evaluating means, that the temperature setting value is a more energy-conserving setting than the reference setting value.

The present invention makes it possible to achieve energy conservation through evaluating, when a specific reset time is reached, whether or not the current temperature setting value is a more energy-conserving setting than a reference setting value, and through resetting the current temperature setting value to the reference setting value if it is determined that the current temperature setting value is not the energy-conserving setting. Moreover, in the present invention, when the user has updated the temperature setting value, an evaluation is performed as to whether or not the updated temperature setting value is a more energy-conserving setting than the reference setting value, and if it is evaluated that the updated temperature setting value is a more energy-conserving setting than the reference setting value, an evaluation is performed as to whether or not a specific time interval has elapsed since the updating of the temperature setting value, and if it is evaluated that the specific time interval has elapsed, the reference setting value is updated to the updated temperature setting value, enabling a further achievement of energy conservation.

Moreover, in the present invention, an evaluation is performed as to whether or not a specific time interval has elapsed since the setting or updating of the reference setting value, and if it is evaluated that the specific time interval has elapsed, an evaluation is performed as to whether or not the temperature setting value is a more energy-conserving setting than the reference setting value over a time interval that is at least a specific proportion of the air-conditioning operating time during the specific time interval, and if it is evaluated that the temperature setting value is a more energy-conserving setting than the reference setting value, then a typical value of the temperature setting value during the specific time interval is calculated, and the reference setting value is updated to the typical value, enabling a further achievement of energy conservation.

Moreover, in the present invention, the reference setting value is updated only if the outside temperature on the day on which the user has updated the temperature setting value is within the normal range, making it possible to avoid referencing a user operation when the weather conditions are not normal.

BRIEF DESCRIPTION OF THE DRAWINGS

FIG. 7 is a diagram for explaining an example of the operation of the setting value controlling device according to the other example according to the present invention.

DETAILED DESCRIPTION OF THE PRESENT INVENTION

Figure 1:
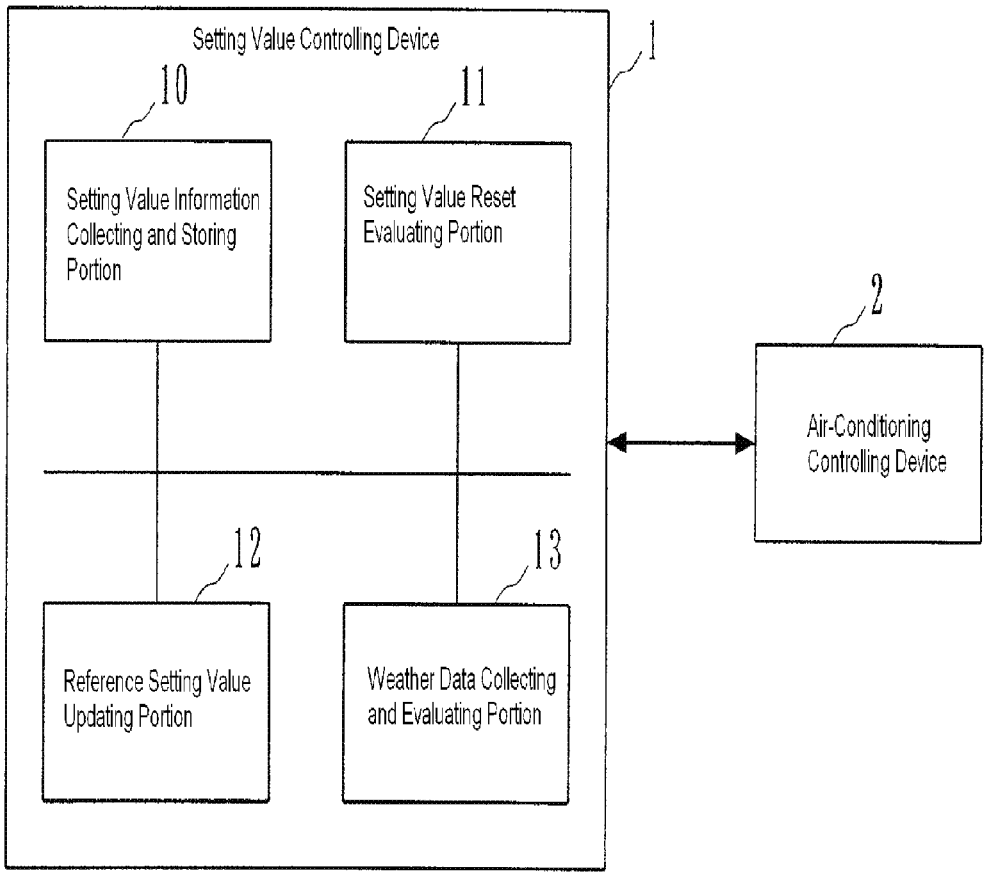
FIG. 1 is a block diagram illustrating a structure of a setting value controlling device according to an example according to the present invention.

Forms for carrying out the present invention are explained below in reference to the figures. FIG. 1 is a block diagram illustrating a structure of a setting value controlling device according to an example of the present invention. A setting value controlling device 1 includes a setting value information collecting and storing portion 10 for collecting and storing temperature setting values that have been set for a space to be air-conditioned; a setting value reset evaluating portion 11 for resetting the temperature setting value to a reference setting value if the temperature setting value is not a more energy-conserving setting than the reference setting value when a specific reset time has been reached; a reference setting value updating portion 12 for updating the reference setting value to the updated temperature setting value if, when the temperature setting value has been updated, the updated temperature setting value is a more energy conserving setting than the reference setting value and a specific time interval has elapsed since updating of the temperature setting value; and a weather data collecting and evaluating portion 13 for evaluating whether or not the outside temperature on the day on which the temperature setting value was updated is within a normal range. The setting value reset evaluating portion 11 has first evaluating means and setting value resetting means, and the reference setting value updating portion 12 has second and third evaluating means and reference setting value updating means.

Figure 2:
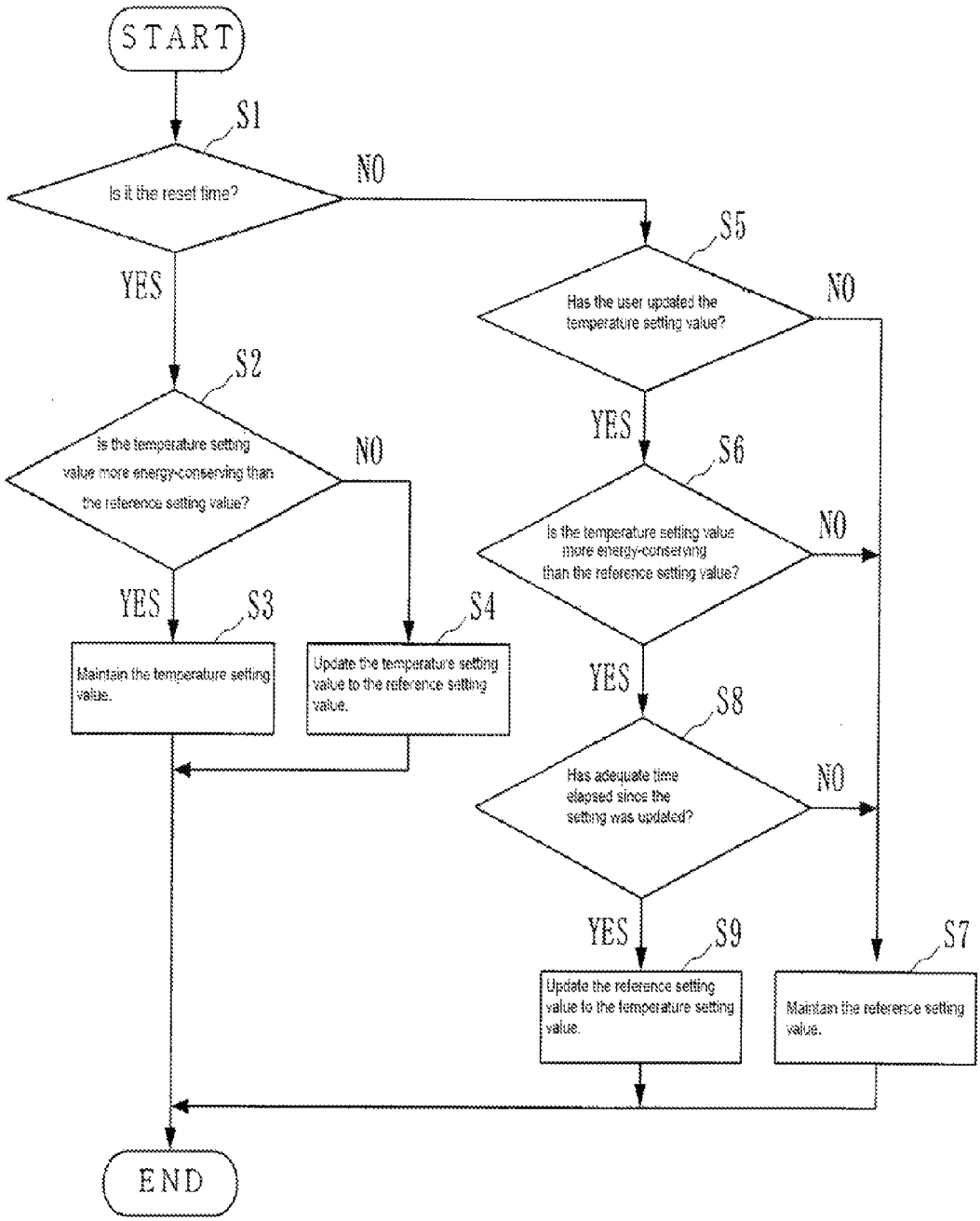
FIG. 2 is a flowchart illustrating the operation of the setting value controlling device according to the present invention.

FIG. 2 will be referenced below to explain the operation of the setting value controlling device 1 according to the present example. First the setting value information collecting and storing portion 10 constantly collects and stores temperature setting values SP from the air-conditioning controlling device 2 that controls the temperature in the controlled space to match the temperature setting value SP. The temperature setting value SP and the controlling mode (the cooling mode or the heating mode) set in the air-conditioner controlling device 2 are updated arbitrarily in response to an instruction from an individual such as a resident of the space or an administrator/operator of the space (hereinafter termed a "user").

The setting value reset evaluating portion 11 evaluates whether or not a specific reset time has been reached (Step S1 in FIG. 2), and if the reset time has been reached, evaluates whether or not the current temperature setting value SP is a more energy conserving setting than the current reference setting value (Step S2). The reset time may be an arbitrary time, or may be a time that varies depending on the state of operation of the facility (for example, the air-conditioning equipment).

If the current controlling mode is the cooling mode and the current temperature setting value SP is no more than the cooling mode reference setting value TCR, then the setting value reset evaluating portion 11 evaluates that the current temperature setting value SP is not an energy-conserving setting, but if the current temperature setting value SP is higher than the cooling mode reference setting value TCR, then the setting value reset evaluating portion 11 evaluates that the current temperature setting value SP is an energy-conserving setting. Additionally, if the current controlling mode is the heating mode and the current temperature setting value SP is no less than the heating mode reference setting value THR, then the setting value reset evaluating portion 11 evaluates that the current temperature setting value SP is not an energy-conserving setting, but if the current temperature setting value SP is lower than the heating mode reference setting value THR, then the setting value reset evaluating portion 11 evaluates that the current temperature setting value SP is an energy-conserving setting.

If the setting value reset evaluating portion 11 evaluates that the current temperature setting value SP is a more energy-conserving setting than the current reference setting value (Step S2: YES), then it maintains the current temperature setting value SP (Step S3). Additionally, if the setting value reset evaluating portion 11 evaluates that it is not an energy-conserving setting, then it resets the current temperature setting value SP to the reference setting value (Step S4). That is, the setting value reset evaluating portion 11 sets the temperature setting value SP=TCR for the air-conditioner controlling device 2 if in the cooling mode, and sets the temperature setting value SP=THR for the air-conditioner controlling device 2 if in the heating mode.

On the other hand, if in Step S1 the reset time has not been reached, then the reference setting value updating portion 12 evaluates whether or not the user has updated the temperature setting value SP (Step S5). If the user has updated the temperature setting value SP, then the reference setting value updating portion 12 evaluates whether or not the updated temperature setting value SP is a more energy-conserving setting than the current reference setting value (Step S6). The evaluation in Step S6 may be achieved in the same manner as in Step S2. If the reference setting value updating portion 12 evaluates that the updated temperature setting value SP is not a more energy-conserving setting than the current reference setting value (Step S6: NO), then it maintains the current reference setting value (Step S7).

Additionally, if the updated temperature setting value SP is a more energy-conserving setting than the current reference setting value, then the reference setting value updating portion 12 evaluates whether or not a specific time interval has elapsed since the time of updating of the setting for the temperature setting value SP (Step S8). Here the specific time interval is preferably a time interval wherein the effect of updating the temperature setting value SP will adequately appear in the room temperature of the controlled space after the updating of the temperature setting value SP, and preferably is set, for example, to twice the time of a time constant Tp, for example, which is a time constant Tp for a model wherein a model for the controlled space has been identified in advance.

If the reference setting value updating portion 12 evaluates that the specific time interval has elapsed since the time of the updating of the setting for the temperature setting value SP (Step S8: YES), then it updates the current reference setting value to the updated temperature setting value SP (Step S9). That is, the reference setting value updating portion 12 sets the reference setting value TCR=SP for the air-conditioner controlling device 2 if in the cooling mode, and sets the reference setting value THR=SP for the air-conditioner controlling device 2 if in the heating mode. Additionally, if the specific time interval has not elapsed since the updating of the setting for the temperature setting value SP, then the reference setting value updating portion 12 maintains the current reference setting value (Step S7).

Figure 3:
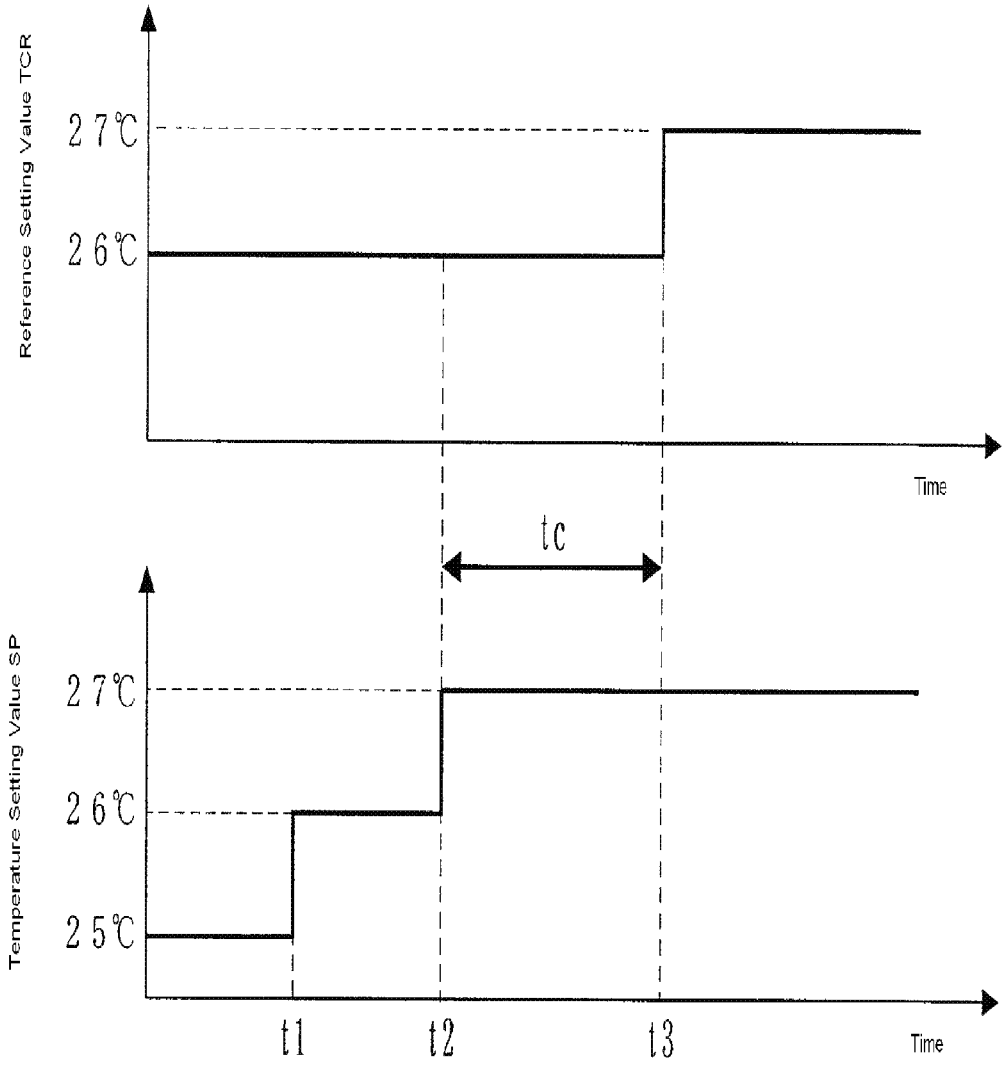
FIG. 3 is a diagram illustrating an example of reference setting value updating by the setting value controlling device according to the example according to the present invention.
Figure 4:
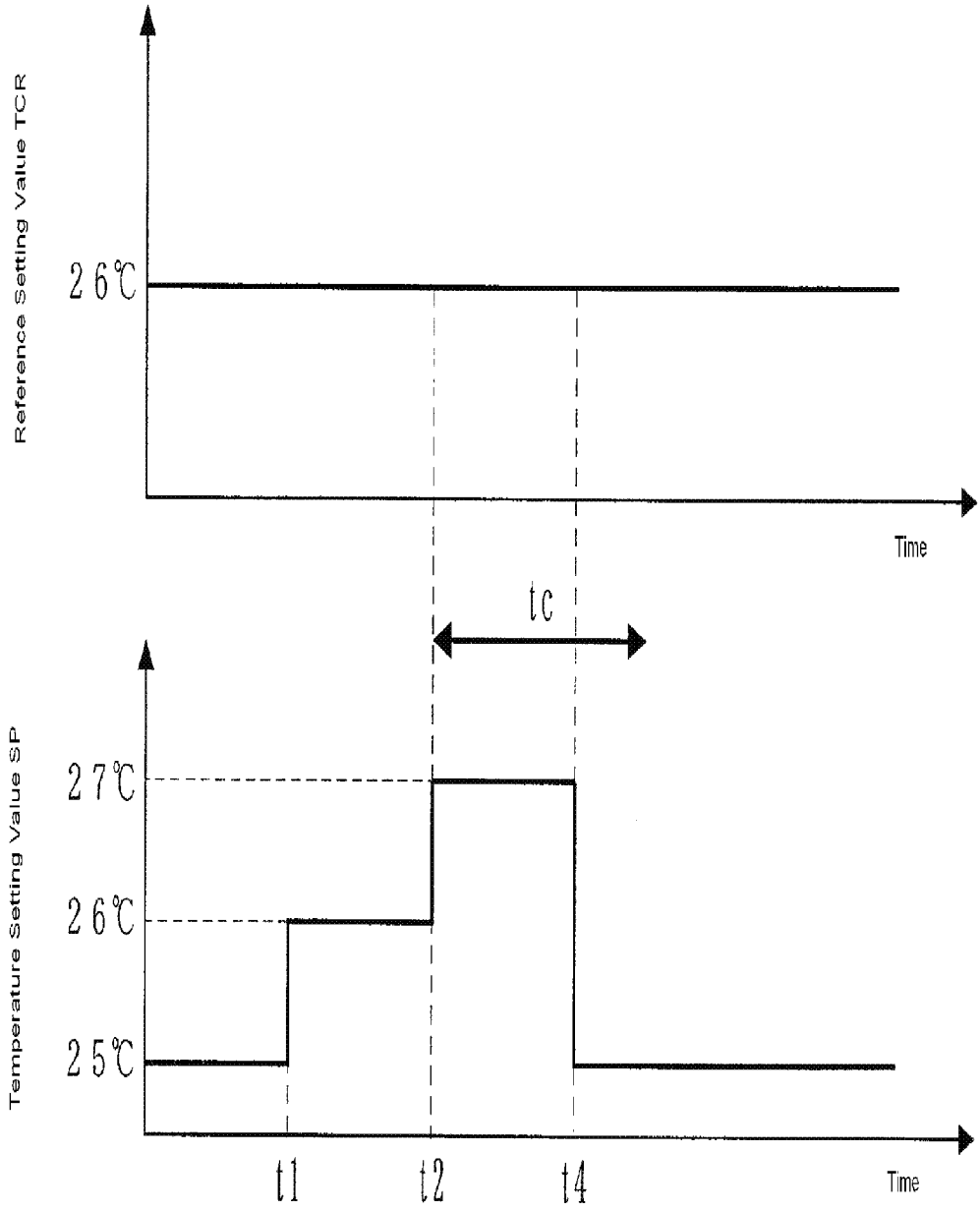
FIG. 4 is a diagram illustrating another example of reference setting value updating by the setting value controlling device according to the present invention.
Figure 5:
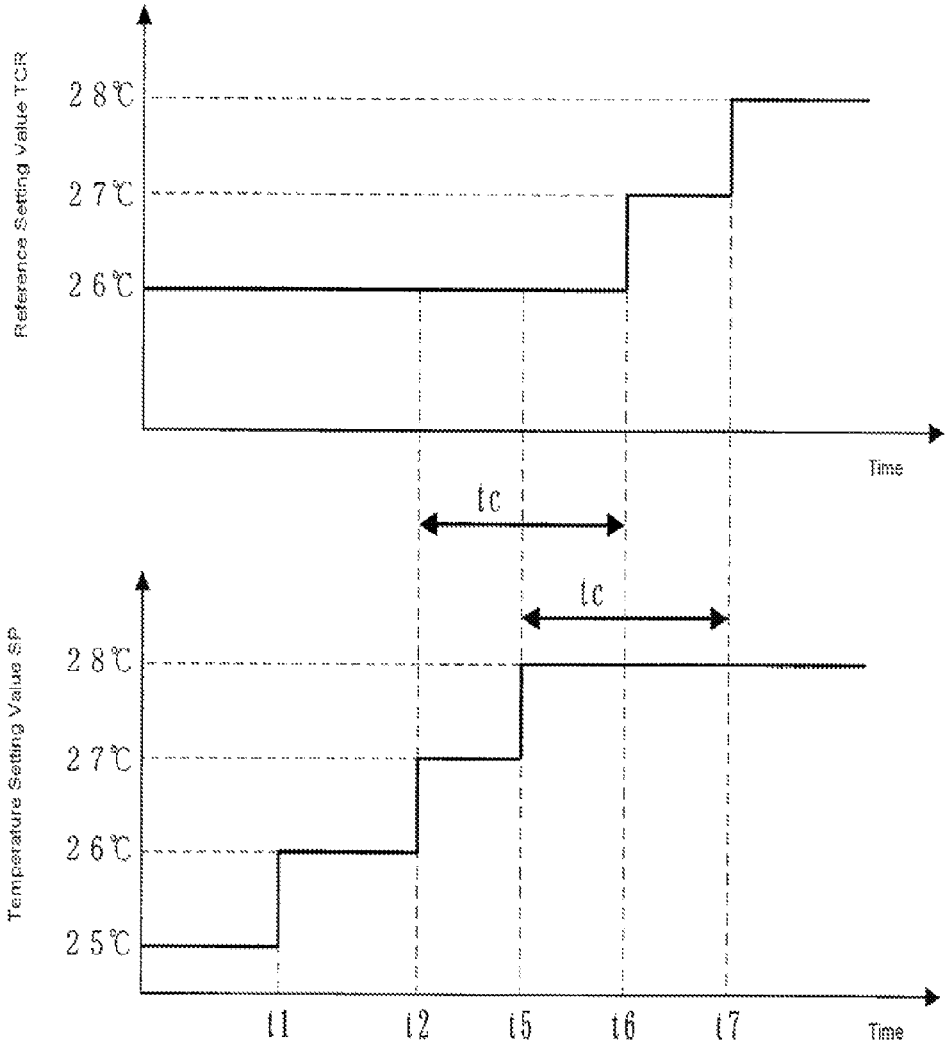
FIG. 5 is a diagram illustrating another example of reference setting value updating by the setting value controlling device according to the present invention.

FIG. 3 through FIG. 5 are diagrams illustrating an example of the reference setting value updating according to the present invention. Note that FIG. 3 through FIG. 5 illustrate a case wherein the controlling mode is the cooling mode. In the example in FIG. 3, at the reset time t1, the setting value reset evaluating portion 11 resets the temperature setting value SP=25° C. to the reference setting value TCR=26° C., after which, at time t2, the user changes the temperature setting value SP to 27° C. In this case, the updated temperature setting value SP=27° C. is a more energy-conserving setting than the reference setting value TCR=26° C. Additionally, at time t3, wherein the specific time interval tc has elapsed since the setting update time t2 for the temperature setting value SP, the reference setting value updating portion 12 updates the reference setting value TCR from 26° C. to 27° C.

The example in FIG. 4 is identical to the example in FIG. 3 until the time t2; however, at time t4, prior to the specific time interval tc elapsing after the setting update time t2 for the temperature setting value SP, the user updates the temperature setting value SP to 25° C. Because of this, the reference setting value TCR is not updated, and the current reference setting value TCR=26° C. is maintained.

The example in FIG. 5 is identical to the example in FIG. 3 until the time t2; however, at time t5, prior to the specific time interval tc elapsing after the setting update time t2 for the temperature setting value SP, the user further updates the temperature setting value SP to 28° C. in this case, the updated temperature setting value SP=28° C. is a more energy-conserving setting than the reference setting value TCR=26° C. The reference setting value updating portion 12, at time t6, wherein the specific time interval tc has elapsed from the setting update time t2 for the updating of the temperature setting value SP to 27° C., updates the reference setting value TCR from 26° C. to 27° C., and then, at time t7, wherein the specific time interval tc has elapsed from the setting update time t5 for the further updating of the temperature setting value SP to 28° C., updates the reference setting value TCR from 27° C. to 28° C.

As described above, in the present example, when the user has updated the temperature setting value SP, if the updated temperature setting value SP is a more energy-conserving setting than the reference setting value and if the update is maintained for an extended period of time, then the setting operation is evaluated as not being an error, and the reference setting value is updated to the updated temperature setting value SP. As a result, in the present example it is possible to achieve further energy conservation through updating the reference setting value automatically based on setting updates by the user.

Figure 6:
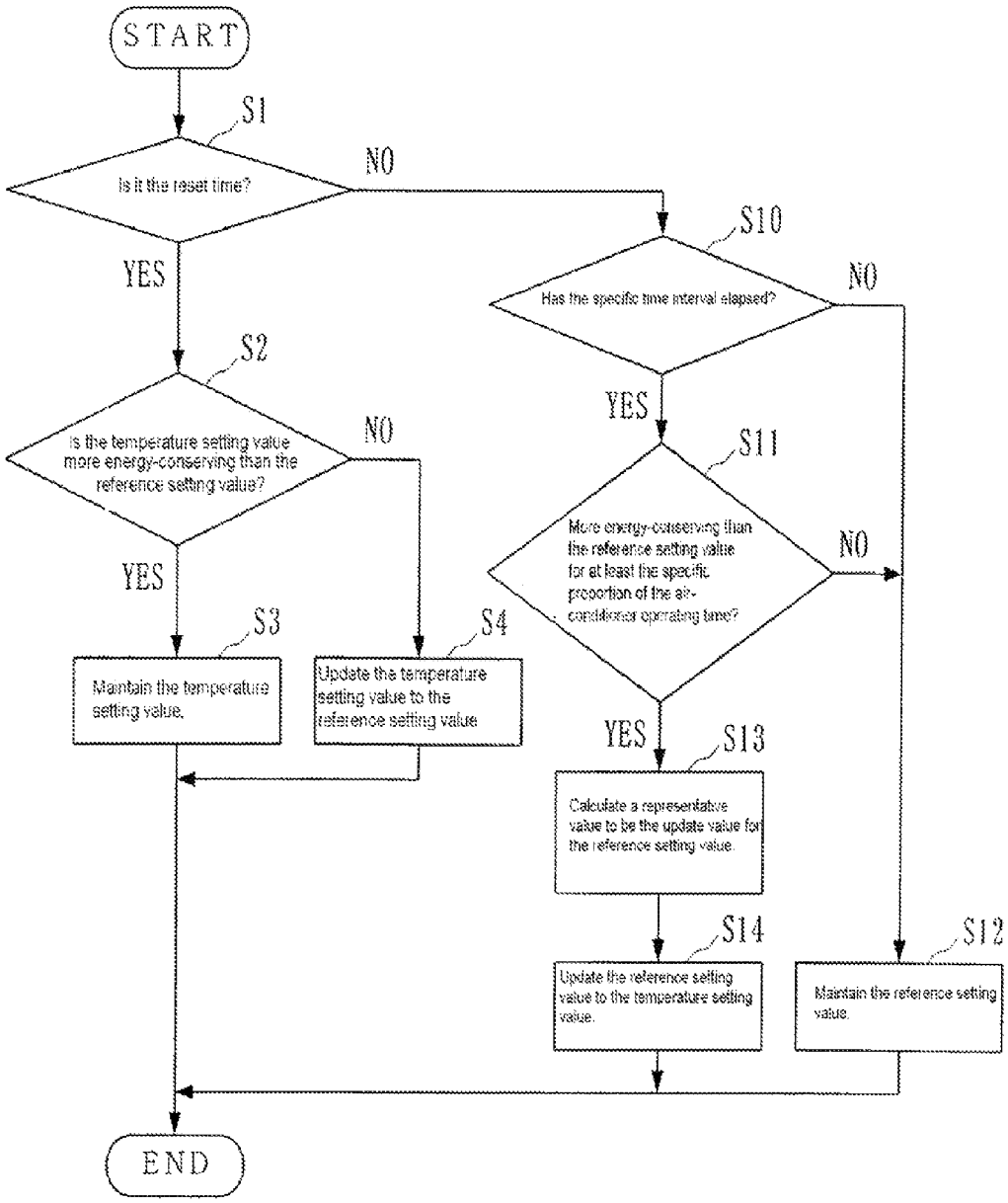
FIG. 6 is a flowchart illustrating the operation of the setting value controlling device according to another example of the present invention.

Another example according to the present invention is explained next. In the present example as well, the structure of the setting value controlling device is identical to the above, and thus the codes in FIG. 1 will be used in the explanation. In the present form, the reference setting value updating portion 12 has second and third evaluating means, representative value calculating means, and reference setting value updating means. FIG. 6 is a flowchart illustrating the operation of a setting value controlling device according to this example.

The processes in Step S1 through S4 are as were explained above. The reference setting value updating portion 12 of the setting value controlling device 1 evaluates whether or not a specific time interval has elapsed since the previous setting/updating of the reference setting value (Step S10 in FIG. 6). If the reference setting value updating portion 12 evaluates that the specific time interval has not elapsed (Step S10: NO), then it maintains the current reference setting value (Step S12). If the specific time interval has elapsed, the reference setting value updating portion 12 evaluates whether or not the temperature setting value SP is a more energy-conserving setting than the reference setting value in a time that is at least a specific proportion of the air-conditioning operating time interval during that specific time interval (Step S11). If the reference setting value updating portion 12 evaluates that the time over which the temperature setting value SP is a more energy-conserving setting than the current reference setting value is shorter than the time of the specific proportion of the air-conditioner operating time during the specific time interval (Step S11: NO), then it maintains the current reference setting value (Step S12).

Additionally, if the time over which the temperature setting value SP is a more energy-conserving setting than the reference setting value is equal to or greater than the specific proportion of the air-conditioner operating time during the specific time interval, then the reference setting value updating portion 12 calculates a representative value for the temperature setting value SP over the specific time interval (Step S13). A representative value at a specific time during that specific time interval may be used for the representative value, or a representative value during a time interval wherein the temperature setting value SP was a more energy-conserving setting than the reference setting value may be used as the representative value. Moreover, the reference setting value updating portion 12 updates the current reference setting value to the representative value calculated in Step S13 (Step S14).

FIG. 7 is a diagram for explaining an example of operations according to the present invention. The example in FIG. 7, shows an example in the summertime wherein two weeks (336 hours) have elapsed since the reference setting value was set to 26° C. and the interval over which the air-conditioner was operated was 120 hours during that two weeks, where, during that air-conditioner operating time, the interval over which the temperature setting value SP was 26° C. was 30 hours, the interval over which the temperature setting value SP was 26.5° C. was 45 hours, and the interval over which the temperature setting value SP was 27.5° C. was 45 hours. In this example, the temperature setting value SP was a more energy-conserving setting than the reference setting value for 90 or more hours, corresponding to a specific proportion (75%) of the air-conditioner operating time, and thus the reference setting value is updated to the representative value.

If an average value of the temperature setting value SP for a specific time during the specific time interval is used as the representative value and, for example, if the specific time is defined as the interval over which the air-conditioner was operating, then because the interval over which the temperature setting value SP was 26° C. was 30 hours, the interval over which the temperature setting value SP was 26.5° C. was 45 hours, and the interval over which the temperature setting value SP was 27.5° C. was 45 hours, the representative value for the temperature setting value SP would be (26×30+26.5×45+27.5×45)/120=26.75° C. Consequently, in this case, the reference setting value with the updated from 26° C. to 26.75° C.

Additionally, if an average value of the temperature setting value SP over the time interval wherein the temperature setting value SP was a more energy-conserving setting than the reference setting value is used as the representative value, then because the interval over which the temperature setting value SP was 26.5° C. was 45 hours and the interval over which the temperature setting value SP was 27.5° C. was 45 hours, the representative value for the temperature setting value SP would be (26.5×45+27.5×45)/90=27° C. Consequently, in this case, the reference setting value with the updated from 26° C. to 27° C.

As described above, identical effects as in the above example can be obtained through the present example as well.

Note that in the examples, the setting value controlling device 1 may instead execute the process for updating the reference setting value (Step S9 and S14) only when the outside temperatures the days on which the user updated the temperature setting value SP where within normal temperature ranges. A weather data collecting and evaluating portion 13 may collect data on the outside temperature (the maximum temperature) through a temperature sensor, not shown, or may collect data on the outside temperature from a weather forecasting company, and may evaluate that the outside temperature is within a normal temperature range if the outside temperature on the day on which the user updates the temperature setting value SP is within the normal temperature range relative to the average temperature for that date within a specific time interval (for example, the past 30 years). Conversely, the weather data collecting and evaluating portion 13 may collect data from, for example, a weather forecasting company, as to whether or not the outside temperature is within a normal temperature range. In this way, the reference setting value SP is updated only if the outside temperature on the day on which the user has updated the temperature setting value is within the normal range, making it possible to avoid referencing a user operation when the weather conditions are not normal. Because there is a high probability that a user operation when the weather conditions are not normal will not result in an improvement in the settings for energy conservation, preferably the reference setting value is not updated when the weather conditions are not normal.

The setting value controlling device 1 as set forth in both examples may be embodied through, for example, a computer comprising a CPU, a memory, and an interface, and through a program for controlling these hardware resources. The CPU executes the processes explained in the forms of embodiment, in accordance with a program that is stored in the memory.

The present invention can be applied to technologies for setting appropriately a temperature setting value in order to conserve energy.

The invention claimed is:

1. A setting value controlling method for controlling a temperature setting value that is set for an air-conditioned space wherein an air-conditioning device controls a room temperature, comprising the steps of:

a first evaluating step evaluating whether a current temperature setting value is a more energy-conserving setting than a reference setting value when a specific resetting time has been reached;

a setting value resetting step resetting the current temperature setting value to the reference setting value when it is evaluated, in the first evaluating step, that the current temperature setting value is not at least as an energy-conserving setting as the reference setting value;

a second evaluating step evaluating whether an updated temperature setting value is a more energy-conserving setting than the reference setting value when a user has updated the temperature setting value before the specific resetting time is reached;

a third evaluating step evaluating whether a specific time interval has elapsed since the temperature setting value has been updated, when it is evaluated, in the second evaluating step, that the updated temperature setting value is a more energy-conserving setting than the reference setting value; and a reference setting value updating step updating the reference setting value to the updated temperature setting value when it is evaluated, in the third evaluating step, that the specific time interval has elapsed.

2. The setting value controlling method as set forth in claim 1, further comprising the steps of:

a fourth evaluating step evaluating whether or not an outside temperature on a day on which the user has updated the temperature setting value is within a normal range; wherein:

the reference setting value updating step is performed only if the outside temperature on the day on which the user has updated the temperature setting value is within the normal range.

3. The setting value controlling method as set forth in claim 1, wherein:

the reference setting value updating step, when the user has updated the temperature setting value to a first updated temperature setting value in the direction of an energy-conserving setting and then has updated the temperature setting value to a second updated temperature value again in the direction of an energy-conserving setting prior to the elapsing of the specific time interval, updates the reference setting value to the first updated temperature setting value when the specific time interval has elapsed since the updating to the first temperature setting value, and updates the reference setting value to the second updated temperature setting value when the specific time interval has elapsed since the updating to the second temperature setting value.

4. A setting value controlling method for controlling a temperature setting value that is set for an air-conditioned space wherein an air-conditioning device controls a room temperature, comprising the steps of:

a first evaluating step evaluating whether a current temperature setting value is a more energy-conserving setting than a reference setting value when a specific resetting time has been reached;

a setting value resetting step for resetting the current temperature setting value to the reference setting value when it is evaluated, in the first evaluating step, that the current temperature setting value is not at least as an energy-conserving setting as the reference setting value;

a second evaluating step evaluating whether a specific time interval has elapsed since the time of setting or updating of the reference setting value before the specific resetting time is reached;

a third evaluating step for evaluating whether the temperature setting value is a more energy-conserving setting than the reference setting value for a time period that is no less than a specific proportion of an air-conditioner operating time period over the specific time interval, when it has been evaluated, in the second evaluating step, that the specific time interval has elapsed;

a representative value calculating step calculating a representative value for the temperature setting value over the specific time interval when it has been evaluated, in the third evaluating step, that the temperature setting value is a more energy-conserving setting than the reference setting value; and a reference setting value updating step updating the reference setting value to the representative value when it has been evaluated, in the third evaluating step, that the temperature setting value is a more energy-conserving setting than the reference setting value.

5. The setting value controlling method as set forth in claim 2, further comprising the steps of:

a fourth evaluating step evaluating whether or not an outside temperature on a day on which the user has updated the temperature setting value is within a normal range; wherein:

the reference setting value updating step is performed only if the outside temperature on the day on which the user has updated the temperature setting value is within the normal range.

6. A setting value controlling device for controlling a temperature setting value that is set for an air-conditioned space wherein an air-conditioning device controls a room temperature, comprising:

a setting value information collector collecting temperature setting values from an air-conditioning device;

a first evaluating device evaluating whether a current temperature setting value is a more energy-conserving setting than the reference setting value when a specific resetting time has been reached;

a setting value resetting device resetting the current temperature setting value to the reference setting value when it is evaluated, by the first evaluating device, that the current temperature setting value is not at least as an energy-conserving setting as the reference setting value;

a second evaluating device evaluating whether the updated temperature setting value is a more energy-conserving setting than the reference setting value when a user has updated the temperature setting value before the specific resetting time is reached;

a third evaluating device evaluating whether a specific time interval has elapsed since the temperature setting value has been updated when it is evaluated, by the second evaluating device, that the updated temperature setting value is a more energy-conserving setting than the reference setting value; and a reference setting value updating device updating the reference setting value to the updated temperature setting value when it is evaluated, by the third evaluating device, that the specific time interval has elapsed.

7. The setting value controlling device as set forth in claim 6, further comprising:

a weather data collecting and evaluating device evaluating whether an outside temperature on a day on which the user has updated the temperature setting value is within a normal range; wherein:

the reference setting value updating device updates the reference setting value only if the outside temperature on the day on which the user has updated the temperature setting value is within the normal range.

8. The setting value controlling device as set forth in claim 6, wherein:

the reference setting value updating device, when the user has updated the temperature setting value to a first updated temperature setting value in the direction of an energy-conserving setting and then has updated the temperature setting value to a second updated temperature value again in the direction of an energy-conserving setting prior to the elapsing of the specific time interval, updates the reference setting value to the first updated temperature setting value when the specific time interval has elapsed since the updating to the first temperature setting value, and update the reference setting value to the second updated temperature setting value when the specific time interval has elapsed since the updating to the second temperature setting value.

9. A setting value controlling device for controlling a temperature setting value that is set for an air-conditioned space wherein an air-conditioning device controls a room temperature, comprising:

a setting value information collecting device collecting temperature setting values from an air-conditioning device;

a first evaluating device evaluating whether a current temperature setting value is a more energy-conserving setting than a reference setting value when a specific resetting time has been reached;

a setting value resetting device resetting the current temperature setting value to the reference setting value when it is evaluated, by the first evaluating device, that the current temperature setting value is not a more energy-conserving setting than the reference setting value;

a second evaluating device evaluating whether a specific time interval has elapsed since the time of setting or updating of the reference setting value before the specific resetting time is reached;

a third evaluating device evaluating whether the temperature setting value is a more energy-conserving setting than the reference setting value for a time period that is no less than a specific proportion of an air-conditioner operating time period over the specific time interval when it has been evaluated, by the second evaluating device, that the specific time interval has elapsed;

a representative value calculating device calculating a representative value for the temperature setting value over the specific time interval when it has been evaluated, by the third evaluating device, that the temperature setting value is a more energy-conserving setting than the reference setting value; and a reference setting value updating device updating the reference setting value to the representative value when it has been evaluated, by the third evaluating device, that the temperature setting value is a more energy-conserving setting than the reference setting value.

10. The setting value controlling device as set forth in claim 9, further comprising:

a weather data collecting and evaluating device evaluating whether an outside temperature on a day on which the user has updated the temperature setting value is within a normal range; wherein:

the reference setting value updating device updates the reference setting value only if the outside temperature on the day on which the user has updated the temperature setting value is within the normal range.

* * * * *